US010231526B2

(12) United States Patent
Duru et al.

(10) Patent No.: US 10,231,526 B2
(45) Date of Patent: Mar. 19, 2019

(54) DEVICE FOR HARDENING NAIL VARNISH BY RADIATION

(71) Applicant: L'OREAL, Paris (FR)

(72) Inventors: Nicolas Duru, Paris (FR); Philippe Bonningue, Paris (FR)

(73) Assignee: L'OREAL, Paris (FR)

( * ) Notice: Subject to any disclaimer, the term of this patent is extended or adjusted under 35 U.S.C. 154(b) by 3 days.

(21) Appl. No.: 14/908,232

(22) PCT Filed: Jul. 31, 2014

(86) PCT No.: PCT/EP2014/066547
§ 371 (c)(1),
(2) Date: Jan. 28, 2016

(87) PCT Pub. No.: WO2015/014966
PCT Pub. Date: Feb. 5, 2015

(65) Prior Publication Data

US 2016/0166041 A1 Jun. 16, 2016

(30) Foreign Application Priority Data

Jul. 31, 2013 (FR) ..... 13 57611
Jul. 31, 2013 (FR) ..... 13 57612
Jul. 31, 2013 (FR) ..... 13 57613

(51) Int. Cl.
*A45D 29/00* (2006.01)
*A45D 29/18* (2006.01)
(Continued)

(52) U.S. Cl.
CPC ..... *A45D 29/00* (2013.01); *A45D 29/18* (2013.01); *A45D 31/00* (2013.01); *H05B 33/0854* (2013.01)

(58) Field of Classification Search
CPC .. A45D 29/00; A45D 2200/205; A45D 29/18; A45D 31/00; F26B 3/28; B01J 19/123; G21K 5/08; H05B 33/0854
See application file for complete search history.

(56) References Cited

U.S. PATENT DOCUMENTS 6,762,425 B1 * 7/2004 Strait ..... A45D 29/00 250/455.11
8,450,705 B1 * 5/2013 Chen ..... F26B 3/28 250/492.1
(Continued)

FOREIGN PATENT DOCUMENTS

CN 201227850 Y 4/2009
CN 202842707 U 4/2013
(Continued)

OTHER PUBLICATIONS

Caltech Article retrieved from "https://www.cds.caltech.edu/~murray/wiki/index.php?title=Could_you_give_a_precise_definition_for_%22Control_Law%22%3F&oldid=6669" Categories: CDS 101/110 FAQ—Lecture 2-2 CDS 101/110 FAQ—Lecture 2-2, Fall 2007.
(Continued)

*Primary Examiner* — Brooke Purinton
(74) *Attorney, Agent, or Firm* — Polsinelli PC

(57) ABSTRACT

The invention relates to a device for hardening nail varnish by ultraviolet radiation. The device comprises:
- a bearing surface (26) intended to support the hands or the feet of the user,
- radiation sources (38) able to emit a radiation to harden nail varnish in the form of a light beam to illuminate the nails of the user.

Figure 1:
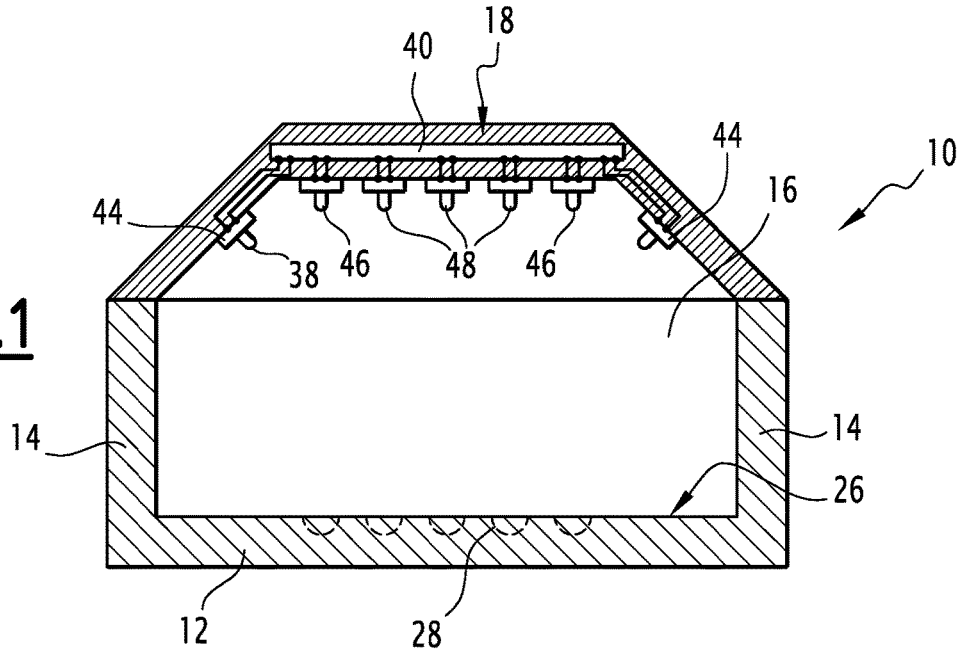

The beams define on the bearing surface (26) at least six illuminated portions (42) separated from each other by a
(Continued)

non-illuminated portion, with the number of illuminated portions (42) being less than nine.

12 Claims, 2 Drawing Sheets

(51) Int. Cl.
*A45D 31/00* (2006.01)
*H05B 33/08* (2006.01)

(56) References Cited

U.S. PATENT DOCUMENTS

2010/0252058 A1* 10/2010 Rehkemper ..... A45D 29/00 132/73
2010/0264835 A1* 10/2010 Bilenko ..... H05B 33/0866 315/152
2010/0305478 A1* 12/2010 Ordway ..... A61B 5/1038 600/587
2011/0252661 A1* 10/2011 Li ..... F26B 3/28 34/275
2011/0277338 A1 11/2011 Li et al.
2012/0187311 A1 7/2012 Vu et al.
2012/0306377 A1* 12/2012 Igaki ..... F21V 23/0464 315/151
2013/0030509 A1 1/2013 Conger
2013/0161531 A1 6/2013 Haile
2013/0255100 A1* 10/2013 Valia ..... F26B 3/347 34/275

FOREIGN PATENT DOCUMENTS

CN 203041082 U 7/2013
DE 202006005790 U1 6/2006
DE 20 2006 020 199 U1 4/2008
EP 0 303 794 A1 6/1988
JP 5036015 B1 9/2012
WO WO 2007/115666 10/2007

OTHER PUBLICATIONS

Pc microcontroller, Wikipedia Article retrieved from https://en.wikipedia.org/wiki/PIC_microcontroller , pp. 1-18, May 30, 2017.
Control Systems, The Electronics Engineers' Handbook, 5th Edition, McGraw-Hill, Section 19, pp. 19.1-19.30, 2005.

* cited by examiner

DEVICE FOR HARDENING NAIL VARNISH BY RADIATION

CROSS REFERENCE TO RELATED APPLICATIONS

This application is a National Phase filing under 35 U.S.C. § 371 of PCT/ep2014/066547 filed on Jul. 31, 2014; and this application claims priority to Application No. 1357613 filed in France on Jul. 31, 2013, Application No. 1357611 filed in France on Jul. 31, 2013; and Application No. 1357611 filed in France on Jul. 31, 2013. The entire contents of each application are hereby incorporated by reference.

This invention relates to a device for hardening nail varnish by radiation, a method for applying nail varnish using such a device and an associated control device.

With the objective of allowing fast drying of nail varnish, device for hardening nail varnish using ultraviolet radiation are used in beauty institutes. Such devices are particularly known from documents US-A-2011/0277338, JP-U-3140109, JP-A-2011/098073, CN-U-201691276, JP-U-3151750, KR-A-100888351 and JP-A-2011/078368.

However, none of these documents make it possible to limit the exposure of the portions of the body not coated with varnish to the ultraviolet radiation although the absorption of ultraviolet radiation at a high dose is harmful to human beings.

There is therefore a need for a device for hardening nail varnish by radiation that makes it possible to reduce the risk of exposure of the portions of the body of the user to ultraviolet radiation.

To this effect, the invention has for object a device for hardening nail varnish by ultraviolet radiation comprising:

a bearing surface intended to support the hands or the feet of a user, sources for emitting radiation for hardening nail varnish in the form of a light beam for illuminating the nails of the user, with the beams defining on the bearing surface at least six illuminated portions separated from each other by a non-illuminated portion, with the number of illuminated portions being less than nine.

According to particular embodiments, the device comprises one or several of the following characteristics taken in isolation or in any technically possible combination:

the number of illuminated portions is equal to seven.

the number of radiation sources is equal to nine, two radiation sources for the illuminated portions the farthest away from the axis and one radiation source for each other illuminated portion.

the two radiation sources for the illuminated portions the farthest away from the axis each have an optical axis, with the two radiation sources being arranged so that the two optical axes form a 45° angle with respect to the normal to the bearing surface.

the device further comprises:

a control circuit able to control the radiation sources according to a control law, each light beam delimiting on the bearing surface an illuminated portion, with the control law depending on the position of the portion illuminated by the beam of the radiation source.

the control law comprises a first control law for a first plurality of radiation sources and a second control law for a second plurality of radiation sources, with the second law being adjustable independently of the first law, with the beams emitted by the first plurality of radiation sources delimiting first illuminated portions on the bearing surface, with the beams emitted by the second plurality of radiation sources delimiting second illuminated portions on the bearing surface, with the first illuminated portions being distinct from the second illuminated portions.

the control law also comprises a third control law for a third plurality of radiation sources, with the third control law being adjustable independently of the first control law and of the second control law, with the beams emitted by the third plurality of radiation sources delimiting third illuminated portions on the bearing surface, the third illuminated portions being distinct from the first illuminated portions and second illuminated portions.

the third plurality of radiation sources comprises three radiation sources.

the control circuit comprises a respective current generator for each plurality of radiation sources.

the device further comprises:

a case provided with walls delimiting an inner space comprising a first space able to receive the distal phalanges of the fingers of the hands or of the feet of the user and a second space able to receive the other portions of the hands or the other portions of the feet of the user, a first presence sensor able to emit a presence signal in the presence of an element at a predefined location, a control circuit able to control the radiation sources according to a control law, with the predefined location being the first space and the control law depending on the presence signal of the first presence sensor.

the device comprises, furthermore, a second presence sensor able to emit a presence signal in the presence of an element in the second space, with the control also depending on the signal of the second presence sensor.

the first presence sensor comprises an active mode in which the first presence sensor is able to emit a presence signal in the presence of an element in the first space and an inactive mode in which the first presence sensor does not emit a presence signal, the first presence sensor being able to switch from the active mode to the inactive mode during the turning on of one of the radiation sources.

at least one radiation source is a light-emitting diode able to emit ultraviolet radiation.

the bearing surface comprises a first zone intended to support the thumbs of the hands of the user, with the first zone comprising the first illuminated portions.

the bearing surface comprises a second zone intended to support the little fingers of the hands of the user, with the second zone comprising the second illuminated portions.

the first plurality of radiation sources comprise two or four radiation sources and the second plurality of radiation sources comprise two radiation sources.

the bearing surface comprises a third zone intended to support the index fingers, the ring fingers and the little fingers of the hands of the user, with the third zone comprising the third illuminated portions.

the bearing surface is provided with at least one mark for positioning the distal phalanges of the fingers of the hands of the user in an irradiation position.

the marks are located in the illuminated portions.

the mark or marks are cells.

the illuminated portions are symmetrical with respect to an axis.

the case comprises a bottom wall, the first presence sensor being able to emit a presence signal in the presence of one or more distal phalanges of an index finger, of a middle finger and/or of a ring finger of a hand of the user, with the first presence sensor being preferably positioned at a distance less than ten centimeters from the bottom wall and preferably at a distance less than five centimeters.

the case comprises a bottom wall and an opening, the second presence sensor being able to emit a presence signal in the presence of a palm or of a wrist of the user, with the second presence sensor being preferably positioned at a distance less than ten centimeters from the opening and preferably at a distance less than five centimeters from the opening.

the control law comprises the turning on of the radiation sources when the two presence sensors emit a presence signal simultaneously.

the control law comprises the closing of the radiation sources when the second presence sensor stops emitting a presence signal.

the control law comprises the closing of the radiation sources when the second presence sensor does not emit a presence signal for a predetermined time.

the first presence sensor comprises an infrared emitter and an infrared detector.

The invention has for object a method for applying a varnish on the nails of the hands of a user comprising the steps of:

introducing into a device for hardening nail varnish by ultraviolet radiation as defined hereinabove of a hand of the user in an irradiation position introducing into the device of the other hand of the user in an irradiation position, with the irradiation positions of the hands having common portions, preferably at least three common portions.

The invention also has for object a method for controlling radiation sources of a device for hardening nail varnish by radiation such as described hereinabove comprising the steps of:

detecting distal phalanges of the fingers of the hands or of the feet of the user by the first presence sensor, emitting a presence signal by the first presence sensor, and turning on of the radiation sources.

According to a particular embodiment, the method for controlling sources comprises a second presence sensor able to emit a presence signal in the presence of an element in the second space and the method also comprises the steps of:

stopping of the emitting of a presence signal by the second presence sensor for a predetermined time, and closing the radiation sources.

According to a first alternative, a device for hardening nail varnish by ultraviolet radiation is proposed, with the device comprising a bearing surface intended to support the hands or the feet of a user, radiation sources for emitting radiation for hardening nail varnish in the form of a light beam for illuminating the nails of the user, with each light beam defining on the bearing surface an illuminated portion, and a control circuit able to control the radiation sources according to a control law. The control law depends on the position of the portion illuminated by the beam of the radiation source.

According to particular embodiments, the device according to the first alternative, comprises one or several of the following characteristics taken in isolation or in any technically possible combination:

at least one radiation source is a light-emitting diode able to emit ultraviolet radiation.

the control law comprises a first control law for a first plurality of radiation sources and a second control law for a second plurality of radiation sources, with the second law being adjustable independently of the first law, with the beams emitted by the first plurality of radiation sources delimiting first illuminated portions on the bearing surface, with the beams emitted by the second plurality of radiation sources delimiting second illuminated portions on the bearing surface, with the first illuminated portions being separated from the second illuminated portions.

the bearing surface comprises a first zone intended to support the thumbs of the hands of the user, with the first zone comprising the first illuminated portions.

the bearing surface comprises a second zone intended to support the little fingers of the hands of the user, with the second zone comprising the second illuminated portions.

the first plurality of radiation sources comprise two or four radiation sources and the second plurality of radiation sources comprise two radiation sources.

the control law also comprises a third control law for a third plurality of radiation sources, with the third control law being adjustable independently of the first control law and of the second control law, with the beams emitted by the third plurality of radiation sources delimiting third illuminated portions on the bearing surface, the third illuminated portions being separate from the first illuminated portions and second illuminated portions.

the bearing surface comprises a third zone intended to support the index fingers, the ring fingers and the little fingers of the hands of the user, with the third zone comprising the third illuminated portions.

the third plurality of radiation sources comprises three radiation sources.

the control circuit comprises a respective current generator for each plurality of radiation sources.

According to a second alternative, a device for hardening nail varnish by ultraviolet radiation is proposed, with the device comprising a bearing surface intended to support the hands or the feet of a user and radiation sources for emitting radiation for hardening nail varnish in the form of a light beam for illuminating the nails of the user. The beams define on the bearing surface at least six illuminated portions separated from each other by a non-illuminated portion, with the number of illuminated portions being preferably less than nine.

According to particular embodiments, the device, according to the second alternative, comprises one or several of the following characteristics taken in isolation or in any technically possible combination:

at least one radiation source is a light-emitting diode able to emit ultraviolet radiation.

the bearing surface is provided with at least one mark for positioning the distal phalanges of the fingers of the hands of the user in an irradiation position.

the marks are located in the illuminated portions.

the mark or marks are cells.

the number of illuminated portions is equal to seven.

the illuminated portions are symmetrical with respect to an axis.

the number of radiation sources is equal to nine, two radiation sources for the illuminated portions the farthest away from the axis and one radiation source for each other illuminated portion.

the two radiation sources for the illuminated portions the farthest away from the axis each have an optical axis, with the two radiation sources being arranged so that the two optical axes form a 45° angle with respect to the normal to the bearing surface.

According to the second alternative, a method for applying a varnish on the nails of the hands of a user is proposed comprising the steps of introducing into a device for hardening nail varnish by ultraviolet radiation, such as described hereinabove, a hand of the user in an irradiation position and introducing into the device of the other hand of the user in an irradiation position. The irradiation positions of the hands have common portions, preferably at least three common portions.

According to a third alternative, a device for hardening nail varnish by ultraviolet radiation is proposed, with the device comprising a case provided with walls delimiting an inner space comprising a first space able to receive the distal phalanges of the fingers of the hands or of the feet of the user and a second space able to receive the other portions of the hands or the other portions of the feet of the user, a first presence sensor able to emit a presence signal in the presence of an element at a predefined location, radiation sources able to emit a radiation in order to harden nail varnish in the form of a light beam in order to illuminate the nails of the user and a control circuit able to control the radiation sources according to a control law. The predefined location is the first space and the control law depends on the presence signal of the first presence sensor.

According to particular embodiments, the device according to the third alternative, comprises one or several of the following characteristics taken in isolation or in any technically possible combination:

the case comprises a bottom wall, the first presence sensor being able to emit a presence signal in the presence of one or more distal phalanges of an index finger, of a middle finger and/or of a ring finger of a hand of the user, with the first presence sensor being preferably positioned at a distance less than ten centimeters from the bottom wall and preferably at a distance less than five centimeters.

at least one radiation source is a light-emitting diode able to emit ultraviolet radiation.

the device comprises, furthermore, a second presence sensor able to emit a presence signal in the presence of an element in the second space, with the control also depending on the signal of the second presence sensor.

the case comprises a bottom wall and an opening, the second presence sensor being able to emit a presence signal in the presence of a palm or of a wrist of the user, with the second presence sensor being preferably positioned at a distance less than ten centimeters from the opening and preferably at a distance less than five centimeters from the opening.

the control law comprises the turning on of the radiation sources when the two presence sensors emit a presence signal simultaneously.

the control law comprises the closing of the radiation sources when the second presence sensor stops emitting a presence signal.

the control law comprises the closing of the radiation sources when the second presence sensor does not emit a presence signal for a predetermined time.

the first presence sensor comprises an active mode in which the first presence sensor is able to emit a presence signal in the presence of an element in the first space and an inactive mode in which the first presence sensor does not emit a presence signal, the first presence sensor being able to switch from the active mode to the inactive mode during the turning on of one of the radiation sources.

the first presence sensor comprises an infrared emitter and an infrared detector.

According to the third alternative, a method for controlling radiation sources of a device for hardening nail varnish by radiation is also proposed comprising a case provided with walls delimiting an inner space comprising a first space able to receive the distal phalanges of the fingers of the hands or of the feet of the user and a second space able to receive the other portions of the hands or the other portions of the feet of the user, a first presence sensor able to emit a presence signal in the presence of an element in the first space, radiation sources able to emit a radiation in order to harden nail varnish in the form of a light beam in order to illuminate the nails of the user and a control circuit able to control the radiation sources. The method comprises the steps of detecting the distal phalanges of the fingers of the hands or of the feet of the user by the first presence sensor, of emitting a presence signal by the first presence sensor, and turning on radiation sources.

According to particular embodiments, the method according to the third alternative, comprises one or several of the following characteristics taken in isolation or in any technically possible combination:

the device comprises, furthermore, a second presence sensor able to emit a presence signal in the presence of an element in the second space.

the method also comprises the steps of stopping the emitting of a presence signal by the second presence sensor for a predetermined time, and of closing radiation sources.

Figure 2:
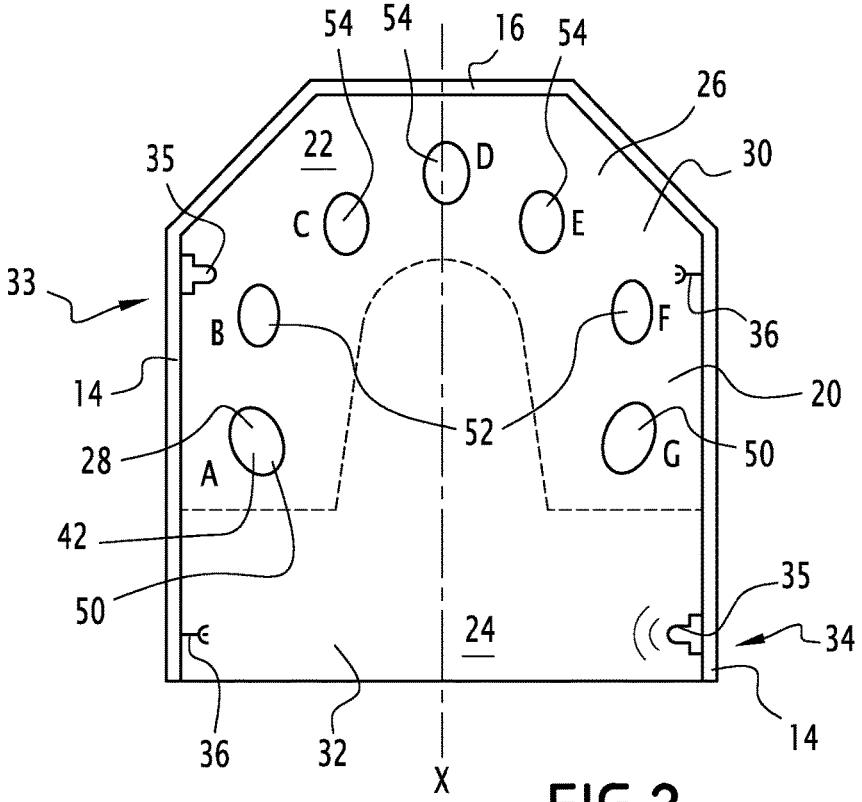
Figure 3:
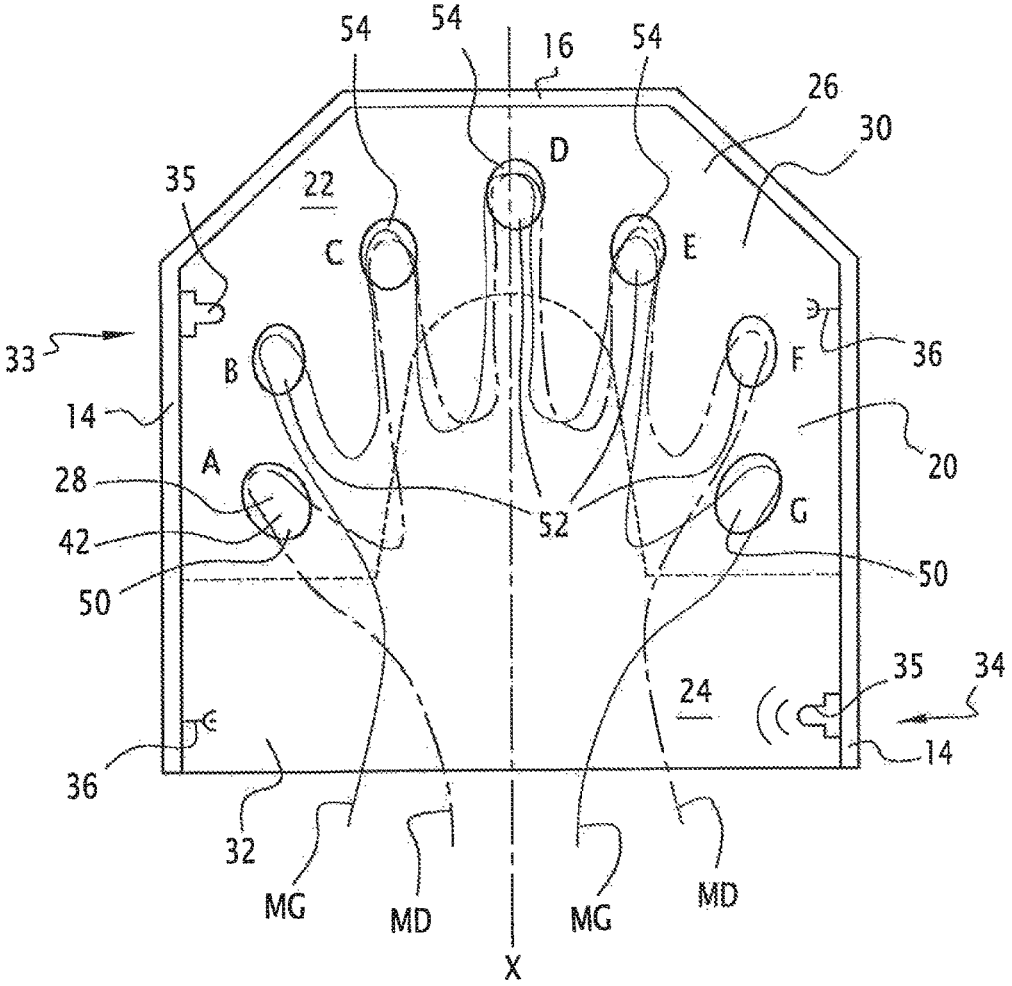

Other characteristics and advantages of the invention shall appear when reading the following description of embodiments of the invention, provided solely as an example and in reference to the drawings which are:

FIG. 1, a side view of a device for hardening according to the invention;

FIG. 2, a top view of the device of FIG. 1 in the absence of the upper wall, and FIG. 3, a top view of the device of FIG. 1 in the absence of the upper wall with the hands of the user introduced into the device.

A device 10 for hardening nail varnish by radiation is shown in FIG. 1.

The term "nail varnish" refers to a photocurable compound applied in the form of a layer on a nail of a user. As an example, a nail varnish as such designates a layer of colorless varnish (layer often referred to as "base coat") intended to facilitate the application of a layer of colored varnish, a layer of colored varnish or a layer of colorless varnish (layer often referred to as "top coat") intended to protect a layer of colored varnish.

The device 10 is able to drive a polymerization of a varnish by the emission of ultraviolet radiation.

Preferably, the ultraviolet radiation is a UV-A radiation. A radiation is a UV-A radiation if its wavelength is between 310 nanometers (nm) and 410 nm. Preferably, the ultraviolet radiation is a radiation of which the wavelength is between 375 nm and 410 nm.

The device 10 has the form of a case comprising an opening, a lower wall 12, two lateral walls 14 facing each other, a bottom wall 16 connected to the two lateral walls 14 and to the lower wall 12 and an upper wall 18 forming a roof with several sides connected to the two lateral walls 14 and to the bottom wall 16.

The walls 12, 14, 16, 18 delimit an inner space 20 of the device 10. In conditions of use, the inner space 20 comprises a first space 22 able to receive the distal phalanges of the fingers of the hands or of the feet of the user and a second space 24 able to receive the other portions of the hands (palm in particular) or the other portions of the feet of the user. The separation between the first space 22 and the second space 24 is indicated by a dotted line in FIG. 2.

The lower wall 12 comprises a bearing surface 26 intended to support the hands of a user of the device 10 and marks 28 in order to position the distal phalanges of the fingers of the hands of the user in an irradiation position by the radiation of the device 10.

The bearing surface 26 comprises a first portion 30 intended to support the distal phalanges of the fingers and a second portion 32 able to support the other portions (palm in particular) of the hands of the user.

The bearing surface 26 is symmetrical with respect to an axis of the case noted as X in FIG. 1.

According to the example of FIG. 1, the marks 28 are cells 28 allowing the fingers to be positioned. The cells 28 are cavities set back with respect to the bearing surface 26. More specifically, in this example, the cells 28 are set back with respect to the first portion 30 of the bearing surface 26.

The lower wall 12 comprises seven cells 28. The seven cells 28 are symmetrical with respect to the axis X. The cells 28 are substantially arranged along a semi-ellipse in such a way that when the latter is passed through from one of its ends to the other in the clockwise direction, the first cell A is intended to support a thumb of the user, the second cell B is intended to support a little finger of the user, the third cell C is intended to support a ring finger or index finder of the user, the fourth cell D is intended to support a middle finger of the user, the fifth cell E is intended to support ring finger or an index finger of the user, the sixth cell F is intended to support a little finger and the seventh cell G is intended to support a thumb of the user.

The lateral walls 14 comprise two presence sensors 33, 34.

The first presence sensor 33 is able to emit a presence signal in the presence of an element in the first space 22. Preferably, as is the case for the example of FIG. 1, the first presence sensor 33 comprises an active mode in which the first presence sensor 33 is able to emit a presence signal in the presence of an element in the first space 22 and an inactive mode in which the first presence sensor 33 does not emit a presence signal.

The first presence sensor 33 is placed in the vicinity of the bottom wall 16 in order to detect the presence of a phalange of an index finger, a phalange of a middle finger and/or a phalange of a ring finger of the user. More precisely, the first presence sensor 33 is placed at a distance less than ten centimeters from the bottom wall 16, preferably less than five centimeters from the bottom wall 16, even less than two centimeters.

The second presence sensor 34 is able to emit a presence signal in the presence of an element in the second space 24. More precisely, the second presence sensor 34 is able to detect the presence of the palm and/or the wrist of the user. The second presence sensor 34 is positioned closer to the opening of the device 10 that the first presence sensor 33. For example, the second presence sensor 34 is positioned at a distance less than five centimeters from the opening, preferably less than two centimeters from the opening.

Each presence sensor 33, 34 comprises an infrared emitter 35 in one of the lateral walls 14 and a detector 36 positioned facing in the other lateral wall 14. The emitter 35 and the detector 36 protrude from their respective lateral wall 14.

The upper wall 18 comprises radiation sources 38 able to emit a radiation to harden nail varnish in the form of a light beam to illuminate the nails of the user and a control circuit 40 of the radiation sources 38.

According to the example of FIG. 1, the radiation sources 38 are light-emitting diodes. A light-emitting diode is often designated by the acronym LED.

A light-emitting diode is an optoelectronic component able to convert electric current in the form of light radiation. Also, each light-emitting diode 38 is characterized by a current—irradiance conversion function of the radiation generated by the diode called characteristic of the light-emitting diode 38, with this characteristic being proper to each light-emitting diode 38. The irradiance is the quantity of radiation produced and is expressed in $W/m^2$ (Watts per square meter).

Each light-emitting diode 38 is able to emit a UV-A ultraviolet radiation. This means that each light-emitting diode 38 emits radiation of which the wavelength is between 310 nm and 410 nm. Preferably, each light-emitting diode 38 is able to emit radiation of which the wavelength is between 375 nm and 410 nm.

In the example shown, each light-emitting diode 38 is able to emit a beam that has a different angular divergence according to the direction considered. More precisely, the main beam of each light-emitting diode 38 is a cone of which the base shape is an ellipse. The lowest angular half-divergence is, preferably, greater than 30°. For the case of FIG. 1, the lowest angular half-divergence is equal to 60°.

The light-emitting diodes 38 are arranged so that the beams define on the bearing surface 26 seven illuminated portions 42 separated from each other by a non-illuminated portion such as is visible in FIG. 2. By definition, a non-illuminated portion is a portion which is not located in the intersection of the main beam emitted by a light-emitting diode 38 with the bearing surface 26.

According to the example of FIG. 2, the cells 28 are located in the illuminated portions 42.

The light-emitting diodes 38 comprise a first plurality 44 of light-emitting diodes 38, a second plurality 46 of light-emitting diodes 38 and a third plurality 48 of light-emitting diodes 38.

The beams emitted by the first plurality 44 of light-emitting diodes 38 delimit first illuminated portions 50 on the bearing surface 26. These first illuminated portions 50 are located on the bearing surface 26 on the first cell A and on the seventh cell G.

The beams emitted by the second plurality 46 of light-emitting diodes 38 delimit second illuminated portions 52 on the bearing surface 26. These second illuminated portions 52 are located on the bearing surface 26 on the second cell B and on the sixth cell F. The second illuminated portions 52 are separate from the first illuminated portions 50.

The beams emitted by the third plurality 48 of light-emitting diodes 38 delimit third illuminated portions 54 on the bearing surface 26. These third illuminated portions 54 are located on the bearing surface 26 on the third cell C, on the fourth cell D and on the fifth cell E. The third illuminated portions 54 are separate from the first illuminated portions 50 and from the second illuminated portions 52.

According to the example of FIG. 1, the upper wall 18 comprises seven light-emitting diodes 38, with the beam of each light-emitting diode 38 generating one of the seven illuminated portions 42.

Furthermore, the first plurality 44 comprises two light-emitting diodes 38, the second plurality 46 two light-emitting diodes 38 and the third plurality 48 three light-emitting diodes 38.

Furthermore, the light-emitting diodes 38 are positioned to illuminate each illuminated portion 50, 52, 54 perpendicularly to the bearing surface 26. This means that, in the particular example of FIG. 1, the optical axis of each light-emitting diode 38 is perpendicular to the bearing surface 26.

Furthermore, each light-emitting diode 38 is located at a distance between 20 mm and 60 mm from the bearing surface 26, preferably each light-emitting diode 38 is located substantially at a distance of 40 mm from the bearing surface 26.

The control circuit 40 is able to control the light-emitting diodes 38 according to a control law.

In the example in FIG. 1, the control law comprises the turning on of the light-emitting diodes 38 when the two presence sensors 33, 34 emit a presence signal simultaneously. The control law also comprises the closing of the light-emitting diodes 38 when the second presence sensor 34 does not emit a presence signal for a predetermined time.

According to another embodiment, the device 10 comprises only the first presence sensor 33. In this embodiment, the control law comprises the turning on of the light-emitting diodes 38 when the first presence sensor 33 emits a presence signal. According to an alternative, the control law also comprises the closing of the light-emitting diodes 38 when the first presence sensor 33 does not emit a presence signal for a predetermined time.

Furthermore, the control law depends on the position of the illuminated portion 50, 52, 54 by the beam of the light-emitting diode 38. More precisely, the control law comprises a first control law controlling the first plurality 44 of light-emitting diodes 38, a second control law controlling the second plurality 46 of light-emitting diodes 38 and a third control law controlling the second plurality 48 of light-emitting diodes 38. The three control laws can be adjusted independently of each other. In certain cases, the three control laws are therefore separated two-by-two. Preferably, in order to facilitate the controlling of the three pluralities of light-emitting diodes 44, 46, 48, the control circuit 40 comprises a current generator for each plurality of radiation sources 38.

The operation of device 10 is now described in reference to a method for applying varnish.

The user applies to each of the nails of the fingers of the two hands a layer of varnish in a non-polymerized state.

A relative symmetry has been noticed, in particular with respect to the axis X, between the left hand MG and the right hand MD of the user. This can be seen in FIG. 3, when the user partially superposes her right hand MD on her left hand MG so that several fingers of the right hand MD rest on fingers of the left hand MG. More precisely, in the case of FIG. 3, the index of the right hand MD rests on the ring finger of the left hand MG starting from the end of the nail of the ring finger of the left hand MG, the middle finger of the right hand MD rests on the middle finger of the left hand MG starting from the end of the nail of the middle finger of the left hand MG and the ring finger of the right hand MD rests on the index of the left hand MG starting from the end of the nail of the index of the left hand MG. As such, seen from the top, the nail of the index finger of the right hand MD and the nail of the ring finger of the left hand MG, the nail of the middle finger of the right hand MD and the nail of the middle finger of the left hand MG and the nail of the ring finger of the right hand MD and the nail of the index finger of the left hand MG seem to form a continuous surface whereon was applied a layer of varnish to be polymerized. Furthermore, in this position of superposition, the little finger of the left hand MG is found between the thumb of the right hand MD and the ring finger of the left hand MG whereon rests the index finger of the right hand MD while the little finger of the right hand MD is located between the thumb of the left hand MG and the index finger of the left hand MG whereon rests the ring finger of the right hand MD. It appears as such that the set of nails of the two hands MG and MD are located in only seven separate zones of the bearing surface 26.

The user then inserts her right hand MD into the inner space 20 of the device 10. The second presence detector 34 then detects the introducing of the hand into the device 10.

The user then positions the distal phalanges of her right hand MD on the cells 28. More precisely, the user positions the distal phalanges of her right thumb in the first cell A, the distal phalanges of her right index finger in the third cell C, the distal phalanges of her right middle finger in the fourth cell D, the distal phalanges of her right ring finger in the fifth cell E and the distal phalanges of her right little finger in the sixth cell F. The user then places her right hand MD in the position of irradiation.

The first presence sensor 33 then detects the presence of fingers in the first space 22. The detecting of the fingers causes the launching of a process of polymerization of the varnish deposited on the nails.

During this process of polymerization, it is provided to irradiate the nails by a predefined quantity of energy, i.e. to irradiate each nail with a given irradiance for a predetermined time. This predetermined time is called polymerization time. As an example, the irradiance desired on each of the fingers is 45 $mW/cm^2$ and the polymerization time is thirty seconds. In order to irradiate the nails, the control circuit 40 sends a control current to each light-emitting diode 38 so that the light-emitting diode 38 emits a light beam that irradiates at least one nail of the user.

During the process of polymerization, the first presence sensor 33 switches to inactive mode, which grants a certain freedom of movement of the fingers of the user during the process.

Furthermore, if the second presence sensor 34 detects that the hand has been removed from the second space 24, the polymerization process is interrupted, i.e. the light-emitting diodes 38 are closed by stopping their supply with current.

Preferably, the stopping of the supply with current of the light-emitting diodes is carried out after a timing delay in order to prevent untimely stoppages of the device 10. For example, the timing delay is set to five seconds. In the case where the user raises her hand and puts it back before the end of the timing delay, the polymerization process is not interrupted.

After this polymerization time, the user removes her right hand MD from the device 10, with the various layers of varnish of her right hand MD being in a polymerized state.

The user then reiterates the operation for her left hand MG. The user then inserts her left hand MG into the inner space 20 of the device 10. The second presence detector 34 then detects the introducing of the hand into the device 10.

The user then positions the distal phalanges of her left hand MG on the cells 28. More precisely, the user positions the distal phalanges of her left little finger in the cell B, the distal phalanges of her left ring finger in the third cell C, the distal phalanges of her left middle finger in the fourth cell D, the distal phalanges of her left index finger in the fifth cell E and the distal phalanges of her left thumb in the seventh cell G. The user then places her left hand MG in the position of irradiation.

In the same way as hereinabove, after a time of polymerization, the various layers of varnish of the left hand MG of the user are in a polymerized state.

It is possible to reverse the order of the method by beginning with the left hand MG of the user then continuing with the right hand MD.

Alternatively, instead of implementing the method for one hand then for the other hand, the user simultaneously places her hands MD, MG into the device 10 by superposing them with a slight offset as shown in FIG. 3 in such a way as to simultaneously dry the nails of the fingers of the two hands MD, MG.

In both cases, the user dries their hands MG, MD one after the other with portions of the hand in common in the conditions of use. Such as can be seen in FIG. 3, the third cell C is used both for the distal phalanges of the right little finger and of the left index finger, the fourth cell D is used for the distal phalanges of the middle fingers of the two hands MG, MD and the fifth cell E is used for the distal phalanges of the right index finger and of the left little finger.

The method therefore makes it possible to dry a layer of varnish deposited on the nails of a user by ultraviolet radiation while still making it possible to reduce as much as possible the emission of useless ultraviolet radiation.

The device 10 makes it possible to reduce the number of light-emitting diodes 38 involved in the method of applying varnish. The device 10 uses only seven light-emitting diodes 38. This makes it possible to reduce the consumption of the device with respect to using more than about ten light-emitting diodes. The cost is also reduced.

The device 10 makes it possible to ensure that each nail is exposed to radiation of which the irradiance can be reproduced from one polymerization process to another. In particular, the positioning of the fingers is indeed reproducible which prevents the decrease of the irradiance if the distance between the light-emitting diode 38 and the nail is not the expected distance. In addition, the tolerance for an incorrect positioning of the fingers is high due to the fact that the optical axis of the light-emitting diodes 38 is substantially centered on the nail. A tolerance of 1.5 mm is obtained with the device 10.

The device 10 makes possible the use of light-emitting diodes 38 that have different characteristics. This facilitates the developing and the adjusting of the device 10 due to the existence of several control laws that can be adjusted independently.

The device 10 also provides for the safety of the user in order to prevent any harmful exposure to ultraviolet radiation, in particular in the eyes. Each presence sensor as such makes it possible to interrupt the emission of ultraviolet radiation in the case of absence of the hand or of the fingers in the inner space 20 of the device 10.

Furthermore, the device 10 also guarantees a high level of safety in case of a manipulation of the device 10 by an unauthorized person. For example, a child who places his hand on the second presence sensor 34 would not manage to turn on the device 10. Similarly, the presence of a toy in the first space 22 that would be detected by the first presence sensor 33 does not make it possible to turn on the polymerization process.

Alternatively, the first plurality 44 of radiation sources 38 comprises four light-emitting diodes, which is two light-emitting diodes 38 for each of the cells 28 which are intended to support the thumbs of the user. The device 10 then comprises nine light-emitting diodes 38. This makes it possible to provide good homogeneity of the irradiance on each finger, with the thumb being the finger having the nail with the greatest surface.

In order to improve this effect, the optical axes of the two light-emitting diodes 38 form a 45° angle with respect to the normal to the bearing surface 26.

According to another alternative, the control current applied to the light-emitting diode or diodes 38 irradiating the thumb is increased by 10% with respect to the current applied to the other light-emitting diodes 38.

Furthermore, it is possible to apply the device 10 for toes.

The invention claimed is:

1. A device for hardening nail varnish by ultraviolet radiation, wherein the device comprises:

a bearing surface intended to support the hands or the feet of a user, radiation sources able to emit a radiation to harden nail varnish in the form of a light beam to illuminate the nails of the user, with the beams defining on the bearing surface at least six illuminated portions separated from each other by a non-illuminated portion, with the number of illuminated portions being less than nine, wherein the device further comprises a case provided with walls delimiting an inner space comprising a first space able to receive the distal phalanges of the fingers of the hands or of the feet of the user and a second space able to receive the other portions of the hands or the other portions of the feet of the user, a first presence sensor able to emit a presence signal in the presence of an element at a predefined location, wherein the first presence sensor comprises an active mode in which the first presence sensor is able to emit a presence signal in the presence of an element in the first space and an inactive mode in which the first presence sensor does not emit a presence signal, the first presence sensor being able to switch from the active mode to the inactive mode during the turning on of one of the radiation sources, a control circuit able to control the radiation sources, with the predefined location being the first space and the control circuit being able to control the radiation sources depending on the presence signal of the first presence sensor, and a second presence sensor able to emit a presence signal in the presence of an element in the second space, with the control circuit being able to control the radiation sources depending on the signal of the second presence sensor, the control circuit being able to turn on the radiation sources when the two presence sensors emit a presence signal simultaneously and being able to close the radiation sources when the second presence sensor does not emit a presence signal for a predetermined time.

2. The device according to claim 1, in which the number of illuminated portions is equal to seven.

3. The device according to claim 2, wherein the device further comprises:

a control circuit able to control the radiation sources according to a control law, each light beam delimiting on the bearing surface an illuminated portion, with the control law depending on the position of the portion illuminated by the beam of the radiation source.

4. The device according to claim 1, wherein the device further comprises:

a control circuit able to control the radiation sources according to a control law, each light beam delimiting on the bearing surface an illuminated portion, with the control law depending on the position of the portion illuminated on the bearing surface by the beam of the radiation source.

5. The device according to claim 4, in which the control law comprises a first control law for a first plurality of radiation sources and a second control law for a second plurality of radiation sources, with the second law being adjustable independently of the first law, with the beams emitted by the first plurality of radiation sources-delimiting first illuminated portions on the bearing surface, with the beams emitted by the second plurality of radiation sources delimiting second illuminated portions on the bearing surface, with the first illuminated portions being distinct from the second illuminated portions.

6. The device according to claim 5, in which the control law also comprises a third control law for a third plurality of radiation sources, with the third control law being adjustable independently of the first control law and of the second control law, with the beams emitted by the third plurality of radiation sources delimiting third illuminated portions on the bearing surface, the third illuminated portions being distinct from the first illuminated portions and second illuminated portions.

7. The device according to claim 6, in which the third plurality of radiation sources comprises three radiation sources.

8. The device according to claim 7, in which the control circuit comprises a respective current generator for each plurality of radiation sources.

9. The device according to claim 6, in which the control circuit comprises a respective current generator for each plurality of radiation sources.

10. The device according to claim 5, in which the control circuit comprises a respective current generator for each plurality of radiation sources.

11. A method for applying a varnish on the nails of the hands of a user comprising the steps of:

introducing into a device for hardening nail varnish by ultraviolet radiation according to claim 1 of a hand of the user in an irradiation position introducing into the device of the other hand of the user in an irradiation position, with the irradiation positions of the hands having common portions, and controlling radiation sources of the device by the following steps:

detecting distal phalanges of the fingers of the hands or of the feet of the user by the first presence sensor, emitting a presence signal by the first presence sensor, detecting distal phalanges of the fingers of the hands or of the feet of the user by the second presence sensor, emitting a presence signal by the second presence sensor and turning on of the radiation sources when the two presence sensors emit a presence signal simultaneously, and wherein the method further comprises the following steps of:

stopping of the emitting of a presence signal by the second presence sensor for a predetermined time, and at which time closing the radiation sources.

12. The method for applying a varnish on the nails of the hands of a user according to claim 11 wherein the hands have at least three common portions.

* * * * *